US005417434A

United States Patent [19]

Romero

[11] Patent Number: 5,417,434

[45] Date of Patent: May 23, 1995

[54] SINKABLE BOAT GAME APPARATUS

[76] Inventor: Victor M. Romero, 23215 Catskill Ave., Carson, Calif. 90745

[21] Appl. No.: 326,379

[22] Filed: Oct. 20, 1994

[51] Int. Cl.[6] ..... A63B 76/00

[52] U.S. Cl. ..... 273/350; 446/161

[58] Field of Search ..... 273/350; 446/160, 161

[56] References Cited

U.S. PATENT DOCUMENTS

| | | | |
|---|---|---|---|
| 3,350,097 | 10/1967 | Chevrette et al. | 273/350 |
| 3,403,907 | 10/1968 | Keller | 273/350 |
| 3,434,716 | 3/1969 | Schwartz | 273/350 X |
| 3,451,159 | 6/1969 | Springfors | 446/161 |
| 3,456,379 | 7/1969 | Metzger | 43/43.14 |
| 3,652,090 | 3/1972 | Semmens | 273/350 |
| 4,127,271 | 11/1978 | Moustakas | 273/350 X |
| 4,223,894 | 9/1980 | Fabricant | 273/350 X |
| 5,344,156 | 9/1994 | Levin | 273/350 X |

*Primary Examiner*—William H. Grieb
*Attorney, Agent, or Firm*—B; Norman B. Ranier

[57] ABSTRACT

A personal buoyancy boat device for use in water sports games employs an inflatable inner tube retained within a housing of generally torroidal shape. A buoyant deck panel is disposed above the housing and secures two valves emergent from the tube, a first valve for deflation, and a second valve for inflation. A water-collecting target assembly is disposed above the deflation valve. When the target assembly fills with water, its added weight causes depression of the deflation valve, causing the boat device to ride lower in the water. The buoyant deck panel prevents the total submersion of the boat device.

7 Claims, 3 Drawing Sheets

SINKABLE BOAT GAME APPARATUS

BACKGROUND OF THE INVENTION

1. Field of the Invention

This invention relates to aquatic toys and more particularly concerns a variably buoyant floatation device having target means which, when filled with water, actuates valve means causing loss of buoyancy.

2. Description of the Prior Art

Numerous floating target devices have been disclosed in the prior art. Various toys have been employed to provide amusement in bathtubs and swimming pools, etc.. For example, U.S. Pat. No. 4,223,894 to Fabricant discloses a floating target having a variety of novelty "shooting gallery" type targets combined with a manually operated water projecting pump means. This device rewards the shooter with a display of spinning novelties. U.S. Pat. No. 3,652,090 to Semmens discloses a floating buoy target means having a tethered weight means adapted to maintain the position of the floating member. An elongate central post is provided upon which a variety of goals, hoops, or other target means may be impaled to provide amusement derived from a number of different games. Both of the aforesaid inventions are adapted to function primarily as target means capable of providing buoyant forces to float only the targets themselves.

Other target means have been disclosed which have provision for storing accumulated water, thereby diminishing buoyancy as a stream or repeated pulses of water are accumulated within. An example of this simple sinking toy boat device is disclosed in U.S. Pat. No. 3,434,716 to Schwartz. This invention provides a funnel shaped target means through which water may enter an interior chamber and thereby sink the boat. Yet another type of sinking boat target is disclosed in U.S. Pat. No. 3,451,159 to Springfors. This boat utilizes a buoyant elongate vertically disposed plug to seal an aperture in the bottom of its hull. As accumulated water fills the vessel, the plug is floated upwardly, causing the boat to fill and sink. Although such toys have been adapted to provide a sinking target means, such devices are adapted to provide only self-floatation.

Many recreational floatation devices have been disclosed capable of providing sufficient buoyancy and structure to support a person above the surface or partially submerged. It has been commonplace for decades, for example, to utilize an automotive inner tube to provide floatation for an individual "seated" in the center Many games have been devised by creative persons which have provided immeasurable amusement to "tubing" participants. Although inflated tubes provide sufficient buoyancy to float an individual, when deflated no buoyancy is provided. It would therefore be impractical and unsafe to utilize an inner tube alone having deflating means to serve as a sinking target platform and personal buoyancy device.

By U.S. Coast Guard regulation, all small power boats currently under manufacture must provide positive buoyancy while "swamped" with water. Therefore, small boats may be partially sunk while maintaining positive floatation due to the inclusion of closed cell, low density materials. However, small boats are impractical for use in swimming pools and are not easily refloated after swamping. Furthermore, the expense involved in manufacturing prohibits widespread use in sinking boat games.

It is therefore an object of the present invention to provide a personal buoyancy device for use in naval warfare games which promote physical fitness, naval strategy, and amusement.

It is another object of the present invention to provide a buoyancy device of the aforesaid nature having water accumulating target means capable of diminishing the buoyancy of said device as water is accumulated therein.

It is a further object of this invention to provide a buoyancy device of the aforesaid nature having means to provide positive buoyant force to an individual while partially sunk.

It is yet another object of this invention to provide a buoyancy device of the aforesaid nature having means for easily distinguishing a fully floated condition from a swamped condition.

It is still another object of this invention to provide a buoyancy device of the aforesaid nature which is simple to operate and capable of being easily floated through many float/sink cycles.

It is moreover an object of the present invention to provide a buoyancy device of the aforesaid nature which is simple in structure, durable, and amenable to low cost manufacture.

These and other beneficial objects and advantages will be apparent from the following description.

SUMMARY OF THE INVENTION

The above and other beneficial objects and advantages are accomplished in accordance with the present invention by a personal buoyancy device comprised of:

a) a housing of generally toroidal shape having an interior region and upper and lower extremities, said lower extremity having a plurality of water passages, said upper extremity having an annular channel that communicates with said interior region, b) a compliant air-holding tube disposed within said interior region, and having a first valve to facilitate deflation and second valve to facilitate inflation, said valves directed toward said upper extremity, c) a buoyant, substantially flat annular deck panel surmounting said upper extremity in abutment therewith and overlying said annular channel, said panel having a first access bore which receives said first valve and a second access bore which receives said second valve, d) a tubular guide elongated between a top extremity and a bottom extremity associated with said first access bore, e) water accumulating means having an upper section provided with an upwardly facing opening adapted to receive water, and an elongated lower section adapted to reciprocate vertically within said tubular guide and having a closed lower extremity disposed in overlying juxtaposition with said first valve, f) spring means contained within said first access bore and adapted to urge said accumulating means upwardly away from said first valve, and g) a target having a lower extremity adapted to seat within the upper section of said accumulator means and an upper extremity adapted to divert a horizontally directed stream of water downwardly into said upper section, whereby, h) said tube, when inflated with air provides floatation to an individual supported by said device, i) as water from a water gun or other projection means strikes said target, the water is diverted downwardly into said accumulator means, causing the weight of said accumulator means to increase and overcome the upward urging of said spring means, thereby actuating said first valve to allow escape of air from said tube, permitting water to enter the housing through said water passages to diminish the buoyancy of the device, while j) sufficient residual buoyancy is provided by said deck panel to maintain the individual afloat.

In a preferred embodiment, the deck panel is fabricated from closed cell polystyrene or an equivalent material. The inner tube may be fabricated from rubber, polyethylene plastic, or coated nylon fabric. The housing may be fabricated from a thermoplastic resin in an injection molding process and should preferably be of a color easily distinguishable from that of said deck panel.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
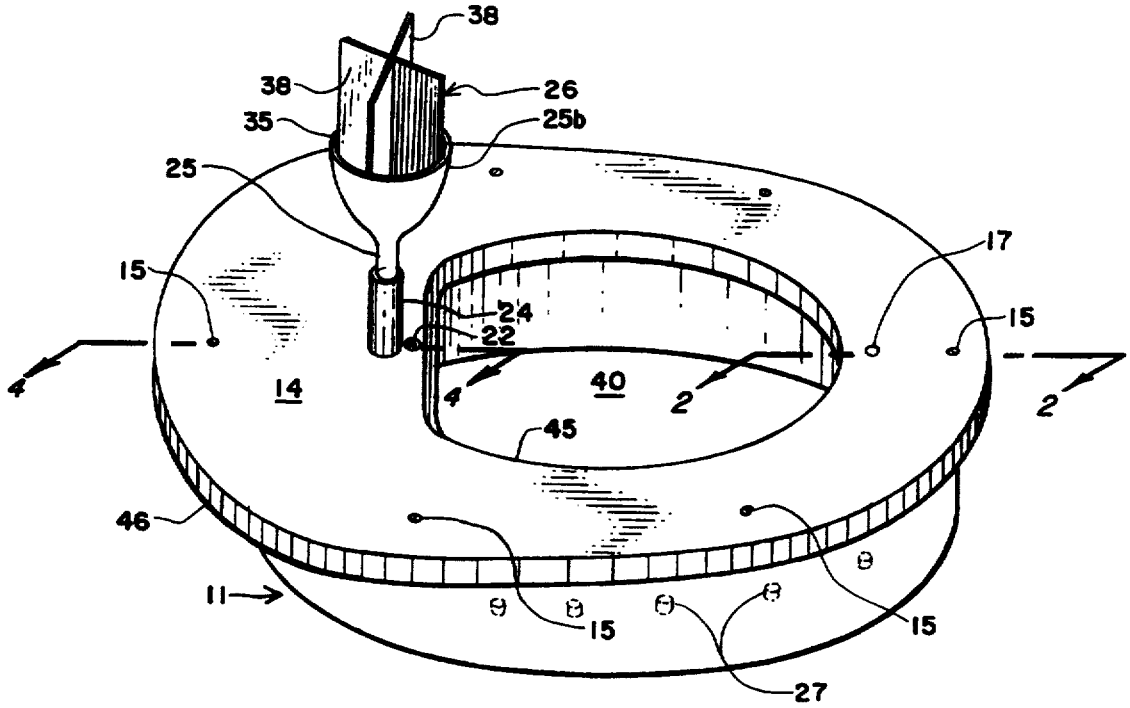
FIG. 1 is a perspective view of an embodiment of the personal buoyancy device of the present invention.
Figure 2:
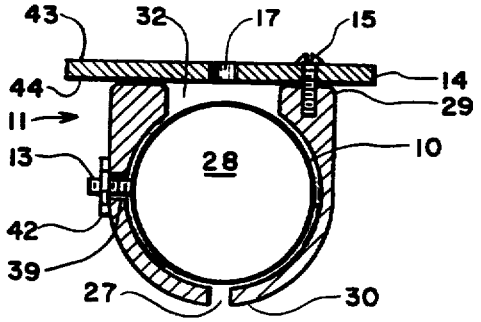
FIG. 2 is a sectional view taken in the direction of the arrows upon the line 2—2 of FIG. 1.

Referring to FIGS. 1–4, an embodiment of the personal buoyancy device of the present invention is shown comprised of an air-holding tube 10 disposed within housing 11. Said tube 10 may be a standard inner tube as employed in tires of automotive vehicles, and fabricated of thin compliant elastomeric material such as natural or synthetic rubber. The tube is provided with first valve 20 to permit deflation of the tube and second valve 21 employed for inflation purposes. Said valves are positioned atop rigid sleeves 12*a*. Flexible extension hoses 12 are interposed between the lower extremity of each sleeve and a site on the interior perimeter of the tube where the valve is otherwise normally emplaced. Check valves 41 may be located in said sleeves to prevent entrance of water. Valve 21 is equipped with protective cap 22.

Housing 11, fabricated preferably of plastic material by way of a molding operation, is of generally toroidal configuration defining a central area 40 and having a trough-like interior region 28 and upper and lower extremities 29 and 30, respectively. Said lower extremity is provided with a series of water passage holes 27. Upper extremity 29 contains an annular channel 32 that permits insertion of tube 10 into said interior region and further permits passage of water. One or more positioning posts 13 may be attached to the tube and caused to penetrate receiving bores 39 in the housing and secured by nut 42 for the purpose of preventing rotation of the tube about its center axis.

Figure 4:
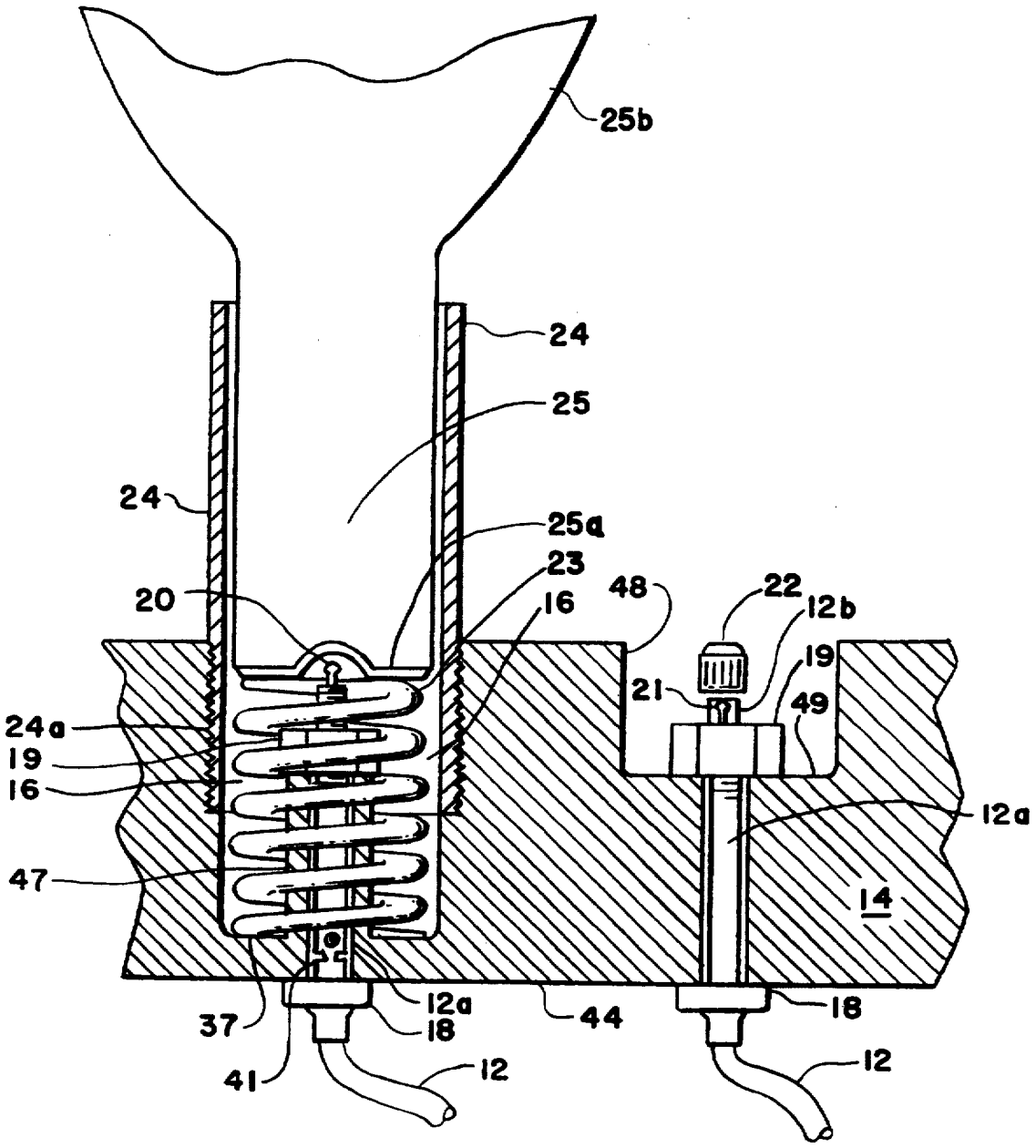
FIG. 4 is an enlarged fragmentary sectional view taken in the direction of the arrows upon the line 4—4 of FIG. 1.
Figure 3:
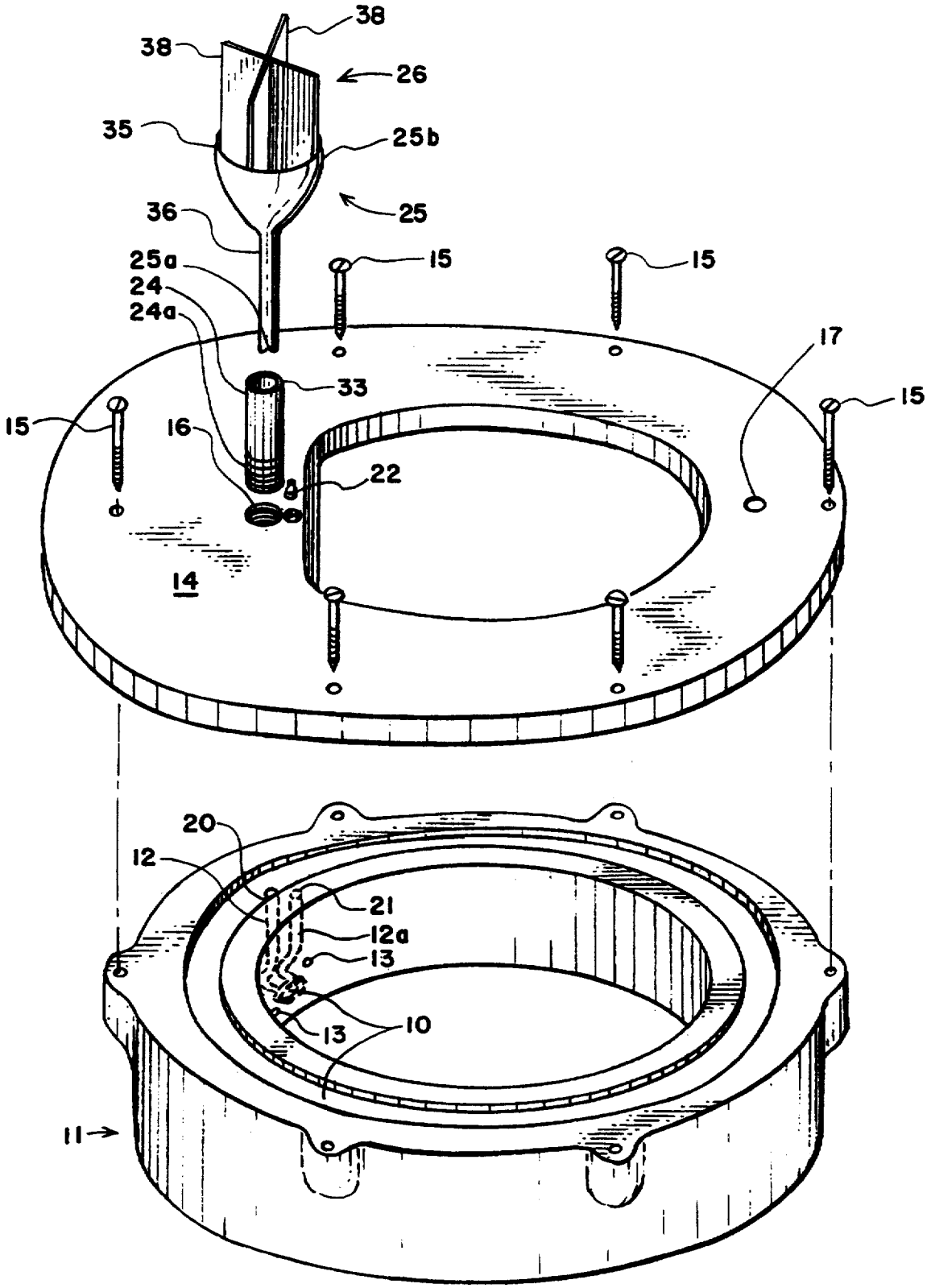
FIG. 3 is an exploded view of the embodiment of FIG. 1.

A deck panel 14 defined by flat upper and lower surfaces 43 and 44, respectively, and inner and outer edges 45 and 46, respectively, is disposed upon the upper extremity of housing 11 in overlying abutment with channel 32, as shown in FIG. 3. Said deck panel may be removably secured to housing 11 by means of screws 15 or other equivalent securing means. Deck panel 14 is fabricated of a highly buoyant material such as a rigid polymer foam as, for example, polystyrene, polyurethane or polyethylene polymers having a closed cell foam structure. As best shown in FIG. 4, a first access bore 16 extends downwardly from upper surface 43 and terminates in a flat annular bottom 37. The upper extremity of bore 16 is threaded. A tubular post 47, integral with panel 14, extends upwardly from bottom 37 on the center axis of bore 16 and receives sleeve 12*a*. Said sleeve is secured by nut 19 which threadably engages said sleeve, and retaining flange 18 which abuts lower surface 44. A second access bore 48 downwardly directed from said upper surface terminates in a flat bottom surface 49 through which sleeve 12*a* protrudes in centered relationship. As in the case of the first access bore, sleeve 12*a* is secured by the interaction of nut 19 with flange 18. An air passage hole 17 may be disposed in the deck panel in diametric opposition to water passage holes 27, and positioned above channel 32.

A tubular guide 24 elongated between a top extremity 33 and threaded bottom extremity 24*a*, engages access bore 16. The joinder of guide 24 with access bore 16 may also be achieved by equivalent alternative means such as bayonet-type mounts or friction fittings.

A water-accumulating member 25 disposed above the deck panel is comprised of funnel-shaped upper portion 25*b* having an upwardly directed opening 35 adapted to receive water, and an elongated lower portion 36. Said lower portion is configured to slideably reciprocate vertically within guide 24, and, as best shown in FIG. 4, is provided with a closed lower extremity 25*a* disposed above valve 20 in close proximity thereto.

A coil spring 23 is disposed about post 47 within access bore 16, and is compressively interactive between the closed lower extremity 25*a* of said water-accumulating member and the bottom 37 of access bore 16. Said coil spring serves to urge the water-accumulating means upwardly away from contact with valve 20.

A target 26 is mounted within upper portion 25*b* of said water-accumulating member. The exemplified target 26 is comprised of crossed panels 38 arranged in a manner to divert a horizontally directed stream of water, from any direction, downwardly into said water-accumulating member.

In operation, a stream of water that strikes target 26 causes water to collect in the water-accumulating member. The attendant increased weight of the water-accumulating member causes lower extremity 25*a* to depress upper valve 20. Such action releases air from the tube, enabling water to enter through holes 27, and causing the device to sink lower in the body of water it is floating in.

In the exemplified embodiment, the portion of deck panel 14 which supports water-accumulating member 25 is of wider construction than other portions of the deck panel. Said portion is considered the front of the device or front of a "boat" represented by the device. Because of the larger front portion, the "boat" will lean slightly to its rear as it loses buoyancy.

The device is designed as a highly maneuverable boat which can be propelled by hand and foot motions of a player positioned within central area 40. The device can be built as a one-man boat, or its size can be increased to accommodate a "gunner", "navigator" and "commander".

In playing a game involving the boat devices of this invention, two or more opposing players with boats and water guns are required. Players are required to wear water goggles to protect their eyes. Streams of water from the water guns are aimed at the targets of the opposing boats. If the players use guns which need to be refilled after running out of water ammunition, it is not a good strategy for a gunner to fire indiscriminately. While a player is reloading, the opposing player will surely take advantage of the moment to close in for the kill.

Whenever possible, opposing players are required to use water guns of the same strength and range.

A player with a disabled or "sunk" boat is considered out of the game; he is no longer allowed to shoot at nearby boats.

Between two combatants, the player whose boat sinks first losses the battle. If both boats sink within three seconds of each other, the battle is a draw.

Between teams or fleets comprised of two or more boats on each side, the team or fleet whose boats are all disabled first losses the naval war game. By mutual agreement, however, the opposing players can make their own rules.

A "sunk" boat can be "repaired" by removing water-accumulating member 25, draining water out of the housing, reinflating tube 10 by way of valve 20 or 21, and re-installing said water-accumulating member.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A personal buoyancy device comprised of:

a) a housing of generally toroidal shape having an interior region and upper and lower extremities, said lower extremity having a plurality of water passages, said upper extremity having an annular channel that communicates with said interior region, b) a compliant air-holding tube disposed within said interior region, and having a first valve to facilitate deflation and second valve to facilitate inflation, said valves directed toward said upper extremity, c) a buoyant, substantially flat annular deck panel surmounting said upper extremity in abutment therewith and overlying said annular channel, said panel having a first access bore which receives said first valve and a second access bore which receives said second valve, d) a tubular guide elongated between a top extremity and a bottom extremity associated with said first access bore, e) water accumulating means having an upper section provided with an upwardly facing opening adapted to receive water, and an elongated lower section adapted to reciprocate vertically within said tubular guide and having a closed lower extremity disposed in overlying juxtaposition with said first valve, f) spring means contained within said first access bore and adapted to urge said accumulating means upwardly away from said first valve, and g) a target having a lower extremity adapted to seat within the upper section of said accumulator means and an upper extremity adapted to divert a horizontally directed stream of water downwardly into said upper section, whereby, h) said tube, when inflated with air provides floatation to an individual supported by said device, i) as water from a water gun or other projection means strikes said target, the water is diverted downwardly into said accumulator means, causing the weight of said accumulator means to increase and overcome the upward urging of said spring means, thereby actuating said first valve to allow escape of air from said tube, permitting water to enter the housing through said water passages to diminish the buoyancy of the device, while j) sufficient residual buoyancy is provided by said deck panel to maintain the individual afloat.

2. The device of claim 1 wherein said valves are equipped with rigid sleeves that secure said valves within said deck panel.

3. The device of claim 1 wherein said tubular guide threadably engages said first access bore.

4. The device of claim 1 wherein the upper section of said water accumulating means is of larger cross-sectional area than the lower section of said water accumulating means.

5. The device of claim 2 wherein the rigid sleeve associated with said first valve passes axially through a post centered within said first access bore.

6. The device of claim 5 wherein said spring means is a coil spring disposed about said post.

7. The device of claim 1 wherein said target is comprised of crossed panels removable from said accumulator means.

* * * * *